US005399364A

United States Patent [19]

Verdan

[11] Patent Number: 5,399,364

[45] Date of Patent: Mar. 21, 1995

[54] COSMETIC ASSEMBLY DEFINED BY ENCASED STICK OF ALUM

[76] Inventor: Francis Verdan, Combamare 19, 2025 Chez-Le-Bart, Switzerland

[21] Appl. No.: 73,494

[22] Filed: Jun. 9, 1993

[30] Foreign Application Priority Data

Jun. 9, 1992 [CH] Switzerland ..... 01825/92

[51] Int. Cl.[6] ..... A61K 7/38; A61K 33/06; C01B 17/96

[52] U.S. Cl. ..... 424/698; 423/544; 424/DIG. 5; 424/65; 424/68; 473/35; 473/36; 473/37; 473/38; 473/39

[58] Field of Search ..... 424/DIG. 5, 68, 64, 424/698; 514/848, 827, 828; 472/35, 36, 37, 38, 39; 423/544

[56] References Cited

U.S. PATENT DOCUMENTS

| | | | |
|---|---|---|---|
| 1,476,965 | 12/1923 | Grant | 424/73 |
| 1,510,934 | 10/1924 | Grant | 424/73 |
| 1,527,745 | 2/1925 | Miller | 424/73 |
| 1,576,567 | 3/1926 | Buhl-Bonanno | 424/DIG. 5 |
| 2,523,683 | 9/1950 | DeMario | 424/DIG. 5 |
| 2,626,847 | 1/1953 | Brown | 424/DIG. 5 |
| 2,628,624 | 2/1953 | DeMario | 424/DIG. 5 |
| 2,838,442 | 6/1958 | McMaster | 424/DIG. 5 |
| 2,890,987 | 6/1959 | Hilfer | 424/DIG. 5 |
| 3,180,827 | 4/1965 | Martinek et al. | 424/DIG. 5 |

FOREIGN PATENT DOCUMENTS

| | | | |
|---|---|---|---|
| 388850 | 5/1956 | Belgium | 424/73 |
| 533187 | 5/1923 | France | 424/73 |
| 612437 | 10/1926 | France | 424/73 |

*Primary Examiner*—Dale R. Ore
*Attorney, Agent, or Firm*—Bacon & Thomas

[57] ABSTRACT

A cosmetic assembly includes a stick of alum (1) deodorant, that is formed with a transverse passage (3) in which is placed a fixing pin made of an elastic material, and a casing in which the stick is placed. The fixing pin (4) is adapted to engage the inside wall of the casing (2) so as to fix the stick of alum within the casing by friction. The cosmetic assembly of the present invention enables sticks of alum of varying sizes to be used with standard type casings.

8 Claims, 1 Drawing Sheet

COSMETIC ASSEMBLY DEFINED BY ENCASED STICK OF ALUM

BACKGROUND OF THE INVENTION

1. Field of the Invention

The present invention pertains to a cosmetic assembly primarily used as a deodorant and, more particularly, to the mounting arrangement of a stick of alum within a casing.

2. Discussion of the Prior Art

Crystalline alum, whether it be potassium alum or ammonium alum, is currently used in cosmetics, primarily as a deodorant. Often, the crystalline alum is sold in the form of a block which can be grasped by the hand of a user and passed over parts of the user's body where deodorant is desired. When used in this manner, the crystallized alum is grasped directly so that the user's fingers come in direct contact therewith.

While such direct contact does not present any risk from health and hygiene standpoints, consumers nonetheless prefer these cosmetic products to be packaged in such a way that the hand does not have to come in direct contact with the product itself. Therefore, it is widely known to provide outer casings, generally made of a plastic material or metal, within which the crystalline alum is stored such that the hand of a user need only contact the outer casing in order to apply the alum to the body.

In housing crystalline alum within an outer casing, there is an obvious advantage in using existing casings since the costs involved in formulating new casings is rather high, such as when a special mold must be manufactured for the injection of plastic or molten metal therein. Unfortunately, using an existing casing for different crystalline alum pieces creates certain problems since the alum is in the form of a crystalline block which often cannot be readily adapted to be fixed into an existing casing. In fact, it is substantially impossible to properly fit blocks of alum into existing casings of a predetermined size, since each block of alum has a substantially fixed shape.

Therefore there exists a need in the art for a cosmetic assembly which permits various blocks of alum to be set within an existing casing in a frictionally fit manner such that the alum will not readily fall out of the casing.

SUMMARY OF THE INVENTION

In accordance with the present invention, various sticks of alum which can vary in shape can be frictionally maintained within casings of the same size so as to alleviate the need to manufacture individually sized casings. This function is performed by providing a cosmetic assembly including a casing having a bottom wall and an open top spaced by a sidewall which defines an inside wall of the casing and a stick of alum that has a lower portion located within the casing and an upper portion extending above the open top of the casing. The lower portion of the stick of alum is formed with a passage that extends substantially perpendicular to and opens into the casing adjacent to the inside wall. A fixing pin, preferably formed of an elastic material, is mounted within the passage and biased into engagement with the inside wall of the casing. With this structure, a stick of alum that is somewhat smaller than the inside dimensions of the casing can still be frictionally maintained within the casing so as to enable the stick of alum to be used, for example, as a deodorant without the user of the cosmetic having to directly grasp the stick of alum.

Other features and advantages of the present invention will become more readily apparent from the detailed description of preferred embodiments thereof when taken in conjunction with the drawings wherein like reference characters refer to corresponding parts in the several embodiments.

DETAILED DESCRIPTION OF THE PREFERRED EMBODIMENTS

A cosmetic assembly according to a first preferred embodiment of the invention shall now be described with reference to FIG. 1. As shown therein, the cosmetic assembly includes a stick of alum 1 and a casing 2. As clearly shown in FIG. 1, the stick of alum 1 includes a lower portion 1*a* located in casing 2 and an upper portion 1*b* extending out of casing 2. In the embodiment shown, casing 2 includes a bottom wall 2*a* which is integrally formed, preferably by molding, with a sidewall 2*b* that defines an inside wall 2*c* of casing 2. Opposite bottom wall 2*a*, casing 2 defines an open top (not labeled). In the cross-sectional view shown, casing 2 is cylindrical in shape, however, it should be readily understood that the cosmetic assembly of the present invention can be utilized with casings of varying shapes.

Figure 1:
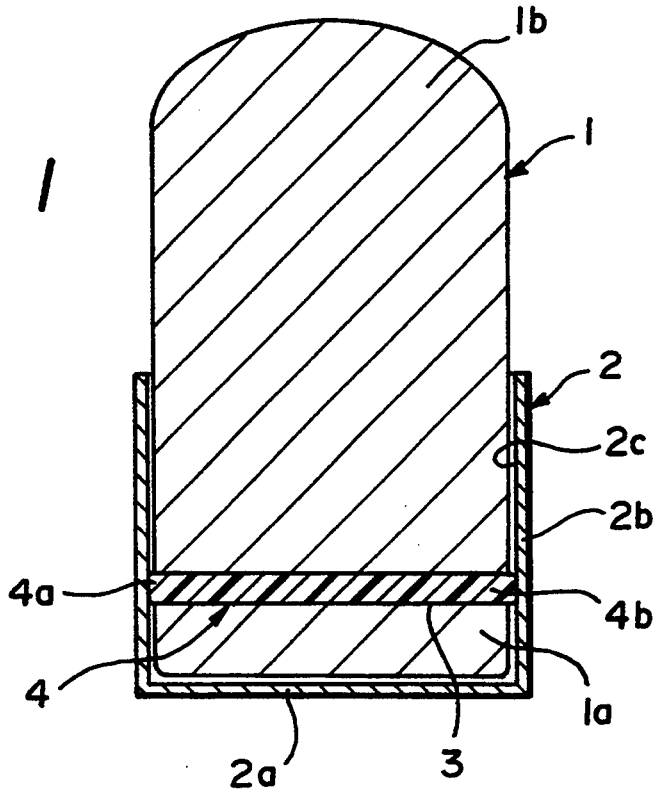
FIG. 1 depicts a cross-sectional view of a stick of alum frictionally fit in a casing according to a first embodiment of the invention.

As clearly shown in FIG. 1, lower portion 1*a* of the stick of alum 1 is formed with a passage 3 that extends entirely through the stick of alum 1 and opens into casing 2 adjacent inside wall 2*c*. Mounted within passage 3 is a fixing pin 4 whose length is predetermined based on the internal dimensions of casing 2. Fixing pin 4 includes opposite ends 4*a*, 4*b* which project outside of passage 3 and engage inside wall 2*c* of casing 2. In this sense, ends 4*a* and 4*b* of fixing pin 4 constitute two studs which frictionally engage inside wall 2*c* of casing 2 so as to prevent the stick of alum 1 from easily falling out of casing 2.

In the preferred embodiment shown in FIG. 1, fixing pin 4 is formed of a single piece that is substantially cylindrical in shape and is made from an elastic material, for example, rubber or a synthetic plastic. Since fixing pin 4 is made of an elastic material, the length thereof can be predetermined based on the inside dimensions of casing 2 such that fixing pin 4 will be slightly compressed by its engagement with inside wall 2*c* of casing 2. Although fixing pin 4 in the preferred embodiment shown in FIG. 1 is an integral piece, it should be recognized that ends 4*a* and 4*b* could be formed as separate elements that are biased outward by a central portion of fixing pin 4. It is also possible, in another embodiment of the invention which is not shown in the drawings, to utilize two studs such as 4*a* and 4*b* which are placed at the extremities of passage 3 and to utilize a coil spring or other biasing member acting between the two so as to cause the desired frictional engagement with inside wall 2*c*.

Figure 2:
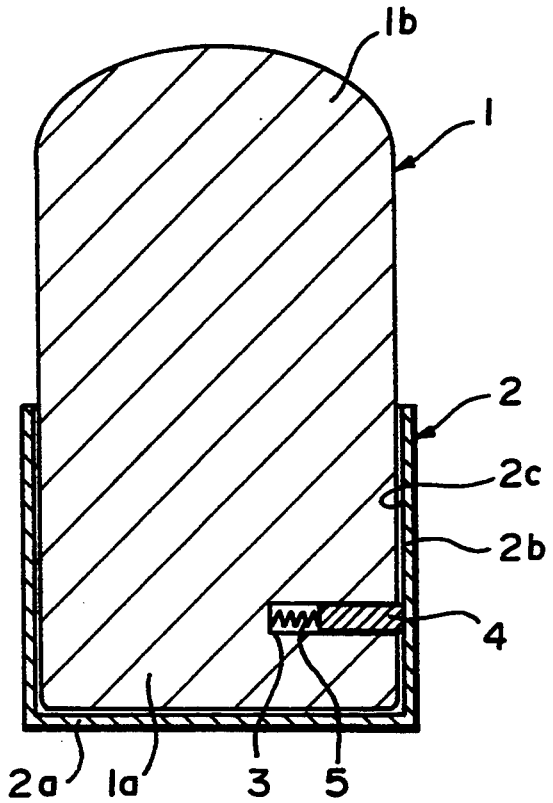
FIG. 2 depicts a cross-sectional view of a stick of alum frictionally fit in a casing according to a second embodiment of the invention.

The embodiment depicted in FIG. 2 differs from that with respect to FIG. 1 in that passage 3 extends into the stick of alum 1 for only a predetermined distance and therefore fixing pin 4 only engages inside wall 2*c* of casing 2 at a single position instead of two spaced positions as in the FIG. 1 embodiment. In the FIG. 2 embodiment, a spring 5 is also located within passage 3 and extends between an internal portion of the stick of alum 1 and fixing pin 4 in order to bias fixing pin 4 and an opposing portion of the stick of alum 1 into engagement with inside wall 2*c* as clearly shown in FIG. 2. In a manner directly analogous to that described with respect to the FIG. 1 embodiment, the arrangement shown and described with respect to the FIG. 2 embodiment functions to bias fixing pin 4 into engagement with inside wall 2*c* so as to create, by friction, pressure which prevents the stick of alum 1 from readily coming out of casing 2.

According to each of the embodiments disclosed, inserting the stick of alum 1 into casing 2 is easily done by pushing the end(s) of fixing pin 4 inward into passage 3 and then positioning lower portion 1*a* of the stick of aluminum 1 into casing 2. By the above description, it should be readily apparent that sticks of alum 1 having sizes which vary with respect to the internal dimensions of casing 2 can be readily, frictionally secured within casing 2 such that the alum can be applied by a user while engaging only casing 2 by hand. By this arrangement, standard types of casings found on the market can be utilized with varying sizes of alum sticks.

Although described with respect to preferred embodiments of the invention, it should be readily understood that various changes and/or modifications may be made to the present invention without departing from the spirit thereof. For example, multiple passages and fixing pins could be utilized to secure the stick of alum within a giving casing. In general, the invention is only intended to be limited by the scope of the following claims.

I claim:

1. A cosmetic assembly comprising:

a casing having a bottom wail and an open top spaced by a side wail, said sidewall defining an inside wail of said casing;

a stick of aium having a lower portion located in said casing and an upper portion extending above the open top of said casing;

a passage formed in the lower portion of said stick of alum, said passage opening into said casing adjacent said inside wail thereof;

a fixing pin mounted in said passage; and elastic means for biasing said fixing pin into engagement with the inside wail of said casing.

2. A cosmetic assembly according to claim 1, wherein said fixing pin is formed of an elastic material.

3. A cosmetic assembly according to claim 2, wherein said elastic material comprises rubber.

4. A cosmetic assembly according to claim 2, wherein said elastic material comprises an elastic synthetic material.

5. A cosmetic assembly according to claim 2, wherein said passage extends entirely through said stick of alum so as to open into said casing adjacent said inside wall thereof at two spaced positions, said fixing pin including two studs located in said passage with each of said studs engaging said inside wall at a respective one of said two spaced positions.

6. A cosmetic assembly according to claim 1, wherein said passage extends entirely through said stick of alum so as to open into said casing adjacent said inside wall thereof at two spaced positions, said fixing pin including two studs located in said passage with each of said studs engaging said inside wall at a respective one of said two spaced positions.

7. A cosmetic assembly according at claim 1, wherein said elastic means comprises at least one spring mounted within said passage.

8. A cosmetic assembly according to claim 1, wherein said passage extends into said stick of alum substantially perpendicular to the sidewall of said casing.

* * * * *